US012617583B2

(12) United States Patent
Ly et al.

(10) Patent No.: US 12,617,583 B2
(45) Date of Patent: May 5, 2026

(54) CONTAINER

(71) Applicants: Hoa Ly, Chicago, IL (US); Ngan Ly, Chicago, IL (US)

(72) Inventors: Hoa Ly, Chicago, IL (US); Ngan Ly, Chicago, IL (US)

( * ) Notice: Subject to any disclaimer, the term of this patent is extended or adjusted under 35 U.S.C. 154(b) by 62 days.

(21) Appl. No.: 17/532,933

(22) Filed: Nov. 22, 2021

(65) Prior Publication Data

US 2023/0054510 A1 Feb. 23, 2023

Related U.S. Application Data

(60) Provisional application No. 63/260,490, filed on Aug. 22, 2021.

(51) Int. Cl.
*B65D 43/02* (2006.01)
*B65D 25/08* (2006.01)
(Continued)

(52) U.S. Cl.
CPC ..... *B65D 25/08* (2013.01); *B65D 43/0218* (2013.01); *B65D 51/1683* (2013.01);
(Continued)

(58) Field of Classification Search
CPC ..... B65D 25/08; B65D 43/0218; B65D 51/1683; B65D 51/18; B65D 2251/0018; B65D 2251/0081; B65D 2543/00194; B65D 2543/00231; B65D 2543/0049; B65D 2543/00537; B65D 2543/00555; B65D 81/24; B65D 83/0005; B65D 2205/04; B65D 21/08; B65D 55/02; B65D 2313/04; B65D 2543/00583; B65D 43/02;
(Continued)

(56) References Cited

U.S. PATENT DOCUMENTS 2,096,358 A * 10/1937 Gautier ..... B65D 81/245 220/580
3,132,570 A 5/1964 Hoffman et al.
(Continued)

FOREIGN PATENT DOCUMENTS

CN 113581604 A * 11/2021
DE 102013009346 12/2014
(Continued)

OTHER PUBLICATIONS

International search report and written opinion, PCT/US 22/39102, ISA/US, Nov. 4, 2022.

*Primary Examiner* — Don M Anderson
*Assistant Examiner* — John Martin Hoppmann
(74) *Attorney, Agent, or Firm* — The Law Offices of Konrad Sherinian LLC; Depeng Bi

(57) ABSTRACT

A container is disclosed. The container has a container body including a sidewall surrounding an interior void with opposite open ends. The sidewall retains a movable panel that moves in opposite longitudinal directions toward the opposite open ends to increase or decrease a storage volume. The movable panel may include a manual sealing and locking mechanism. The container also includes a cover that covers one of the open ends and is openable or removable for access to contents. A one-way valve in the cover, sidewall, or movable panel permits evacuation of excess air from the storage volume.

16 Claims, 3 Drawing Sheets

(51) Int. Cl.
*B65D 51/16* (2006.01)
*B65D 51/18* (2006.01)

(52) U.S. Cl.
CPC ..... *B65D 51/18* (2013.01); *B65D 2251/0018* (2013.01); *B65D 2251/0081* (2013.01); *B65D 2543/00194* (2013.01); *B65D 2543/00231* (2013.01); *B65D 2543/0049* (2013.01); *B65D 2543/00537* (2013.01); *B65D 2543/00555* (2013.01)

(58) Field of Classification Search
CPC ..... B65D 53/02; B65D 1/023; B65D 81/245; B65D 21/086; B65D 47/32; B65D 2543/00101
USPC ..... 220/287, 234, 230, 223, 529, 580, 780; 222/286, 326
See application file for complete search history.

(56) References Cited

U.S. PATENT DOCUMENTS 3,578,467 A * 5/1971 Huber ..... B65D 51/1683 426/106
4,552,090 A * 11/1985 Coleman ..... B65D 90/48 220/222
7,159,736 B1 1/2007 Torelli
7,494,025 B2 2/2009 Porter
9,016,508 B1 4/2015 Leighton et al.
D736,038 S 8/2015 Kilduff et al.
9,533,817 B2 1/2017 Smallwood
10,836,547 B2 * 11/2020 Chapman ..... B65D 53/02
2007/0272698 A1 * 11/2007 Brown ..... B65D 83/0005 220/578
2008/0190933 A1 * 8/2008 Bougon ..... B65D 81/245 220/361
2017/0101303 A1 * 4/2017 Tomesch ..... B67D 3/0051
2018/0093236 A1 4/2018 Johnson et al.
2019/0239699 A1 8/2019 Kent
2019/0241327 A1 8/2019 Loveridge
2019/0322437 A1 10/2019 Lonner et al.
2020/0071059 A1 3/2020 Ryan

FOREIGN PATENT DOCUMENTS

DE 102013009346 A1 * 12/2014 ..... B65D 81/24
GB 2187704 9/1987
GB 2484666 A * 4/2012 ..... A47J 47/02
KR 20140019583 2/2014
KR 200473793 8/2014
KR 20210048026 5/2021
WO 2013144188 10/2013
WO 2014071577 5/2014

* cited by examiner

CONTAINER

CROSS REFERENCE

This application claims the benefit of U.S. Provisional Patent Application No. 63/260,490, filed Aug. 22, 2021, which is incorporated by reference herein in its entirety for all purposes.

FIELD OF THE DISCLOSURE

The present disclosure relates to a storage container with a variable storage volume to minimize or eliminate excess air present in the storage volume with the contents of the container.

SUMMARY

According to an aspect of the disclosure, a container comprises a container body, a movable panel, and a cover. The container body has a sidewall, the sidewall forming a first opening and a second opening. The sidewall having a first end and a second end, the first end peripherally surrounding the first opening, the second end peripherally surrounding the second opening, the sidewall extending longitudinally from the first end to the second end, the sidewall comprising an inner surface. The sidewall also forms an interior void, the interior void peripherally surrounded by the sidewall inner surface and extending from the first opening to the second opening. The movable panel is adapted and configured to be retained within the interior void by the sidewall so as to divide the interior void into a first volume and a second volume. The first volume extends longitudinally from the movable panel to the first opening, and the second volume extends longitudinally from the movable panel to the second opening. The movable panel is adapted and configured to be movable in a first longitudinal direction toward the first opening so as to reduce the first volume while continuing to be so retained by the sidewall. The cover is adapted and configured to be retained by the container body so as to cover the first opening in such a manner that the sidewall, the movable panel so retained by the sidewall, and the cover so retained by the container body enclose a storage volume. The cover so retained by the container body is manually movable to expose the first opening to allow manual dispensing of contents of the storage volume through the first opening. The storage volume comprises at least a portion of the first volume, and the storage volume is configured to be reduced when the first volume is reduced by the movable panel being moved in said first longitudinal direction.

BRIEF DESCRIPTION OF THE DRAWINGS

Although the characteristic features of this disclosure will be particularly pointed out in the claims, the subject matter of the claims, and the manner in which it may be made and used, may be better understood by referring to the following description taken in connection with the accompanying drawings forming a part hereof, wherein like reference numerals refer to like parts throughout the several views and in which:

A person of ordinary skill in the art will appreciate that elements of the figures above are illustrated for simplicity and clarity and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skill in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, unless otherwise clearly stated, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

Figure 1:
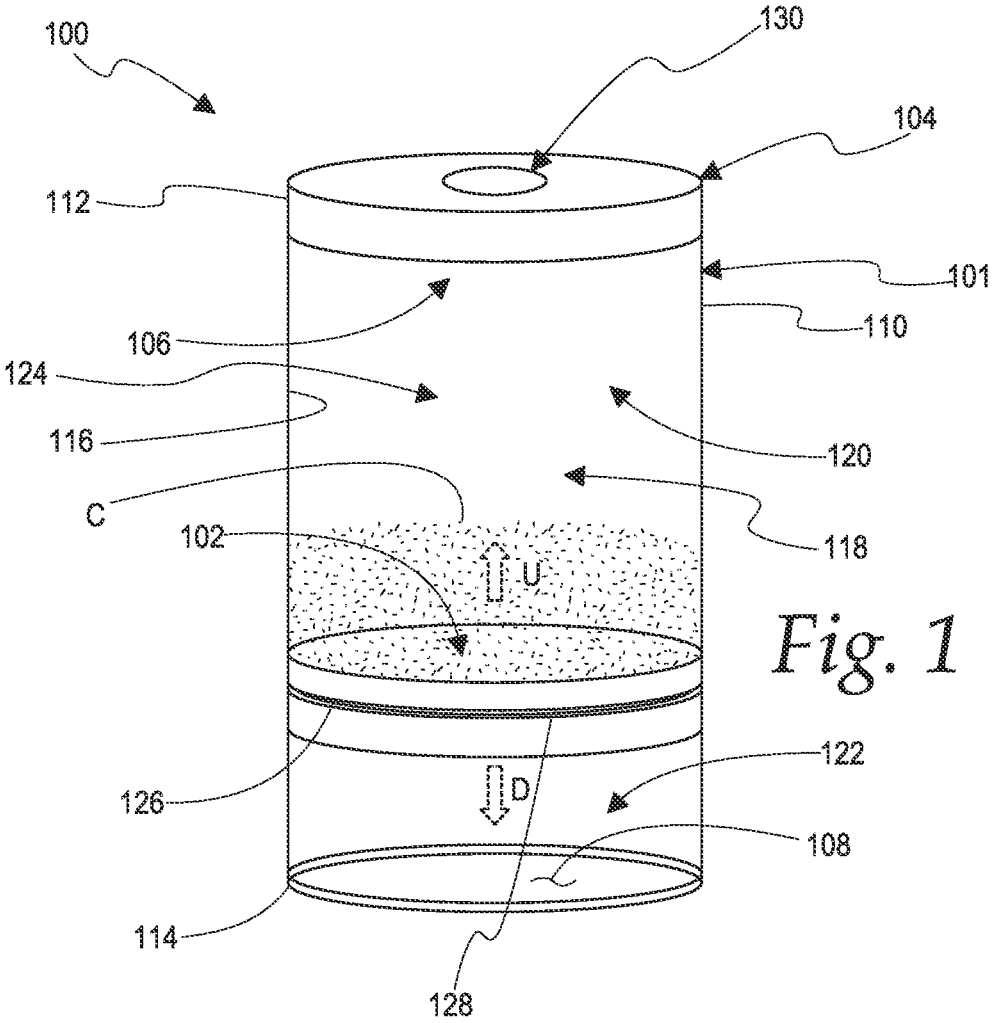
FIG. 1 is a perspective view of a container according to an embodiment of the disclosure.

Embodiments of containers according to the disclosure are illustrated in FIGS. 1-5 as containers 100, 100', 100". Turning to FIG. 1, container 100 comprises a container body 101, a movable panel 102, and a cover 104. The container body 101 comprises a first opening 106, a second opening 108, and a sidewall 110, the sidewall 110 having a first end 112 and a second end 114. The first end 112 peripherally surrounds the first opening 106, and the second end 114 peripherally surrounds the second opening 108. The sidewall 110 extends longitudinally from the first end 112 to the second end 114, the sidewall 110 comprising an inner surface 116. The container further comprises an interior void 118, the interior void 118 being peripherally surrounded by the sidewall inner surface 116 and extending from the first opening 106 to the second opening 108. Containers according to the disclosure may be generally formed in any suitable prismatic shape, such as a circular cylinder as in the illustrated container 100, or a rectangular prism as in the illustrated containers 100' and 100", and the structures described for each of the illustrated embodiments may be adapted and configured for circular cylindrical, rectangular prismatic, or other prismatic shaped containers according to this disclosure.

The movable panel 102 is adapted and configured to be retained within the interior void 118 by the sidewall 110 in the manner shown in FIG. 1, so as to divide the interior void 118 into a first volume 120 and a second volume 122. The first volume 120 extends longitudinally from the movable panel 102 to the first opening 106 and the second volume 122 extending longitudinally from the movable panel 102 to the second opening 108, the movable panel 102 being adapted and configured to be movable in a first longitudinal direction U (upwardly as shown in FIG. 1) toward the first opening 106, so as to reduce the first volume 120 while continuing to be so retained by the sidewall 110. The movable panel 102 is further adapted and configured to be movable in a second longitudinal direction D (downwardly as shown in FIG. 1) toward the second opening 108, so as to increase the first volume 120 while continuing to be so retained by the sidewall 110. To permit the movable panel 102 to be manually moved by a user in the first and second longitudinal directions, the first opening 106 and the second opening 108 are large enough to accommodate a user's hand inserted therethrough to push the movable panel 102. According to embodiments, at least one of a first opening and a second opening is large enough to permit longitudinal insertion of the movable panel therethrough to be retained by a sidewall substantially as described. In particular, the first openings 106, 106', 106" of the illustrated containers 100, 100', 100" are sized and shaped to permit such longitudinal insertion and removal of the movable panels 102, 102', 102" therethrough. In other embodiments (not shown), the second opening is large enough to permit air to fill the second volume when the movable panel is moved toward the first opening, and thus to relieve the second volume of vacuum pressure that could otherwise resist said movement of the movable panel, but not large enough to accommodate a user's inserted hand. Instead, for example, in such embodiments the movable panel may include a ring or other suitable pulling feature on its side facing the first opening, so that a user may reach therethrough to push or pull the movable panel.

The cover 104 is adapted and configured to be retained by the container body 101 so as to cover the first opening 106 so that the sidewall 110, the movable panel 102 so retained by the sidewall 110, and the cover 104 so retained by the container body 101 enclose a storage volume 124. The storage volume 124 comprises at least a portion of the first volume 120, and the storage volume 124 is configured to be reduced when the first volume 120 is reduced by the movable panel 102 being moved in the first longitudinal direction U. The cover 104 so retained by the container body 101 is manually movable to expose the first opening 106 to allow manual dispensing of contents C of the storage volume 124 through the first opening 106. More particularly, the cover 104 so retained by the container body 101 is optionally adapted and configured to be manually removable from the container body 101 to expose the first opening 106. In embodiments not shown, a cover may be movably connected to a container body, such as by a pivotal or sliding joint.

In embodiments, the container 100 permits not only the reduction of the storage volume 124, and thus the amount of excess air present therein at any time, but also airtight sealing of the storage volume 124, so as to prevent excess air from circulating into the storage volume 124. This is believed to extend the freshness of contents C, which may comprise food or another consumable product that degrades more quickly when exposed to excess air. For example, when the contents C comprise cereal, reducing the storage volume 124 as the cereal C is consumed, by raising the movable panel 102 longitudinally upwardly in the direction U so as to accommodate a height of a remaining amount of cereal C with no superfluous headspace, is believed to preserve freshness (and delay staleness) of the cereal C for longer than storing the cereal C in an airtight container with a non-variable storage volume, thus an increasing superfluous headspace above the cereal C, and thus an increasing amount of excess air in the storage volume, as the remaining quantity of cereal C is diminished. In such embodiments, the movable panel 102 is adapted and configured to sealingly engage the sidewall inner surface 116 while so retained by the sidewall 110.

More particularly, an annular sidewall contacting member 126 (e.g., a gasket formed of a suitable resilient, compressible material, such as a rubber/elastomer, such as silicone) is seated in an annular groove 128 formed in a periphery of the movable panel 102, so as to seal an interface between the movable panel 102 and the sidewall inner surface 116. Alternatively, or in addition to being seated in a groove or other mating or complementary feature of a movable panel, a sidewall contacting member according to this disclosure may be permanently affixed to the movable panel, such as by a suitable adhesive or by overmolding. Likewise, the cover 104 is adapted and configured to sealingly engage the container body 101 while so retained by the container body 101, so as to prevent airflow into the storage volume 124. The cover 104 may comprise a suitable known type of annular sealing member (e.g., a silicone or other rubber/elastomer gasket, not shown), which may sealingly engage either or both of the sidewall first end 112 and a region of the sidewall inner surface 116 near or adjacent to the sidewall first end 112.

Containers according to the disclosure may further comprise a valve through which gas can be expelled by moving the movable panel in the first longitudinal direction with the cover on the container. Thus, such a valve may be comprised in at least one of the movable panel, the sidewall (typically at a location that is near the upper/first end of the sidewall), and the cover. The illustrated container 100 shown in FIG. 1 includes a valve 130 comprised in the cover 104 and configured to permit airflow out of the storage volume 124 when the storage volume 124 is reduced by the movable panel 102 being moved in the first longitudinal direction U. In embodiments, the valve 130 is a one-way valve. In other embodiments, the valve 130 is manually openable and closable by a suitable manual actuator (not shown).

Figure 2:
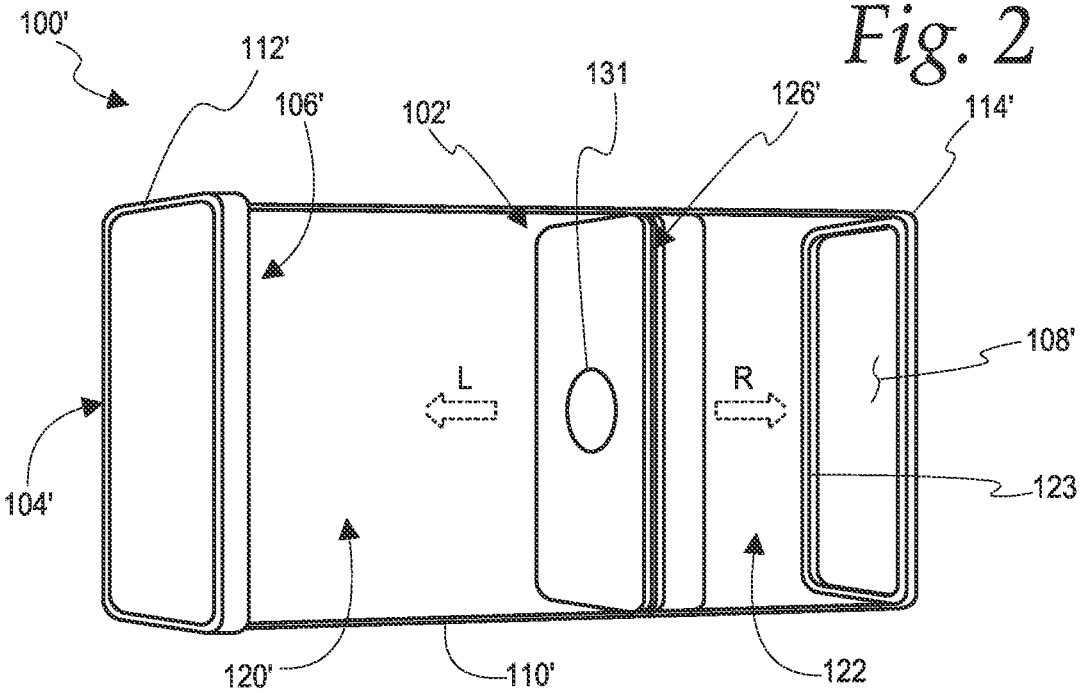
FIG. 2 is a perspective view of a container according to another embodiment.

Another embodiment of a container according to the disclosure is illustrated in FIG. 2 as a container 100', in which structures analogous to those of the container 100 are denoted with like numerals followed by a prime symbol (').

The container 100' is illustrated as resting on its sidewall 110'. Thus, the respective first and second openings 106', 108', which are disposed at opposite first and second ends 112' and 114' of the sidewall 110', are oriented vertically and face in first and second horizontal longitudinal directions L (left) and R (right). The movable panel 102' is adapted and configured to be movable in the first and second longitudinal directions L, R when retained in the sidewall 110', oriented as shown. The container 100' may typically be oriented as depicted only when the cover 104' is closed, such as for shelf storage and/or to move the panel 102' without allowing contents to spill through the first opening 106'. In use according to embodiments, the container 100' or a similar container may even be opened when oriented on its side, such as when used to store non-flowable contents, for example, a loaf of bread.

As also illustrated, the container 100' comprises a stop 123 formed in the sidewall 110'. The stop 123 is disposed adjacent the second opening 108' so as to abut the movable panel 102' when the movable panel 102' is moved in the second longitudinal direction R to a stop position proximate to the second opening 108'. Thus, the stop 123 prevents the movable panel 102' from being manually moved in the second longitudinal direction R beyond the stop position, the movable panel 102' in the stop position continuing to be retained by the sidewall 110' so as to maintain the enclosure of a storage volume 124' when the cover 104' is retained by the container body 101' so as to cover the first opening 106, as described below. The stop 123 is illustrated as an annular, inwardly projecting lip, that extends fully around the perimeter of the second end 114 of the sidewall 110. In other embodiments, a suitable stop may comprise one or a plurality of spaced apart inwardly projecting tabs (not shown), which may collectively overlap significantly less than an entire perimeter of a sidewall. In embodiments, a stop analogous to stop 123 may also be employed in a container otherwise similar to the container 100 of the first illustrated embodiment.

In addition, the cover 104' is illustrated as lacking a venting structure, while the movable panel 102' is illustrated as including an optional valve 131, adapted and configured to vent air from the first volume 120' to the second volume 122', the latter being in fluid communication with the exterior of the container 100'. If the optional valve 131 is omitted, the movable panel 102' may be operated only when the cover 104' is open, such as to move a left side of remaining non-flowable contents (or a top side of flowable or non-flowable contents, if the container 100' is turned vertically, ninety degrees clockwise from its orientation shown in FIG. 2) toward the first end 112' of the container 100', as contents (not shown) are consumed, followed by closing the cover 104' into sealing engagement with the sidewall 110'. In embodiments of a container having a storage volume without venting, it may be desirable for a sealing member of the cover to engage only a first end rather than an inner surface of the sidewall, and/or for the cover to include a suitable known locking mechanism, such as being retained to the sidewall by a threaded connection or a clasp or latch, so as to limit and/or oppose such pressure in the sealed storage volume as may tend to urge the cover open from a closed position, particularly if the cover forms a seal with the container body before being fully closed.

Figure 4:
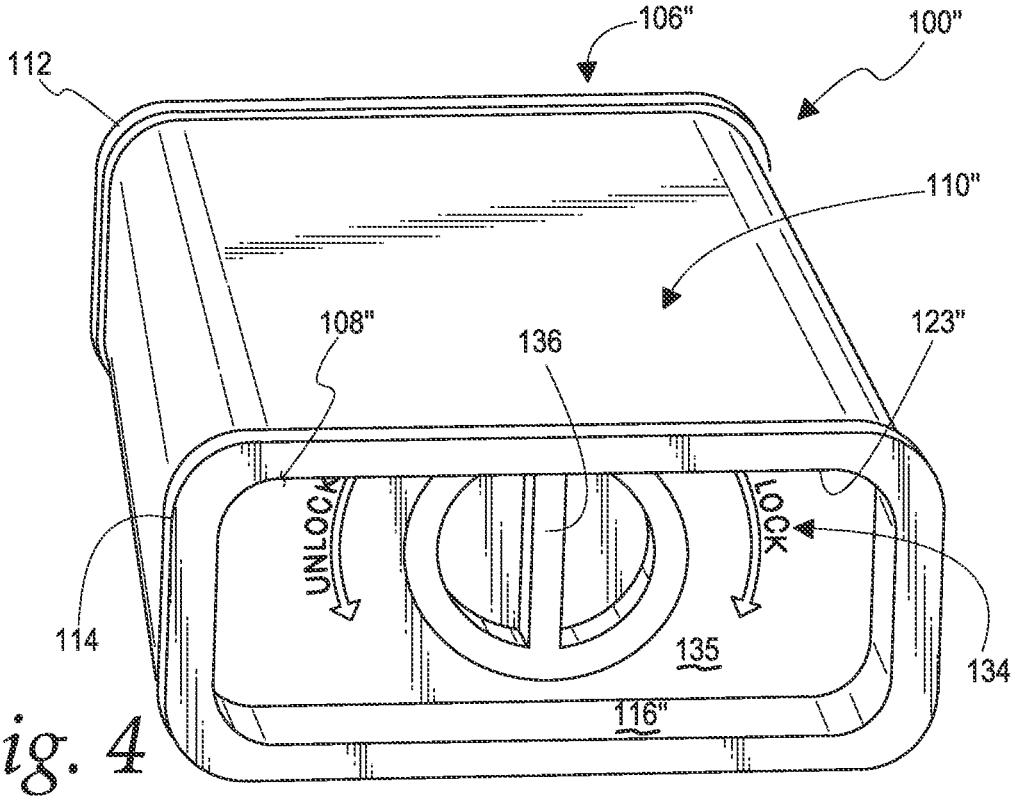
FIG. 4 is a second-end perspective view of the assembled container of FIG. 3.
Figure 3:
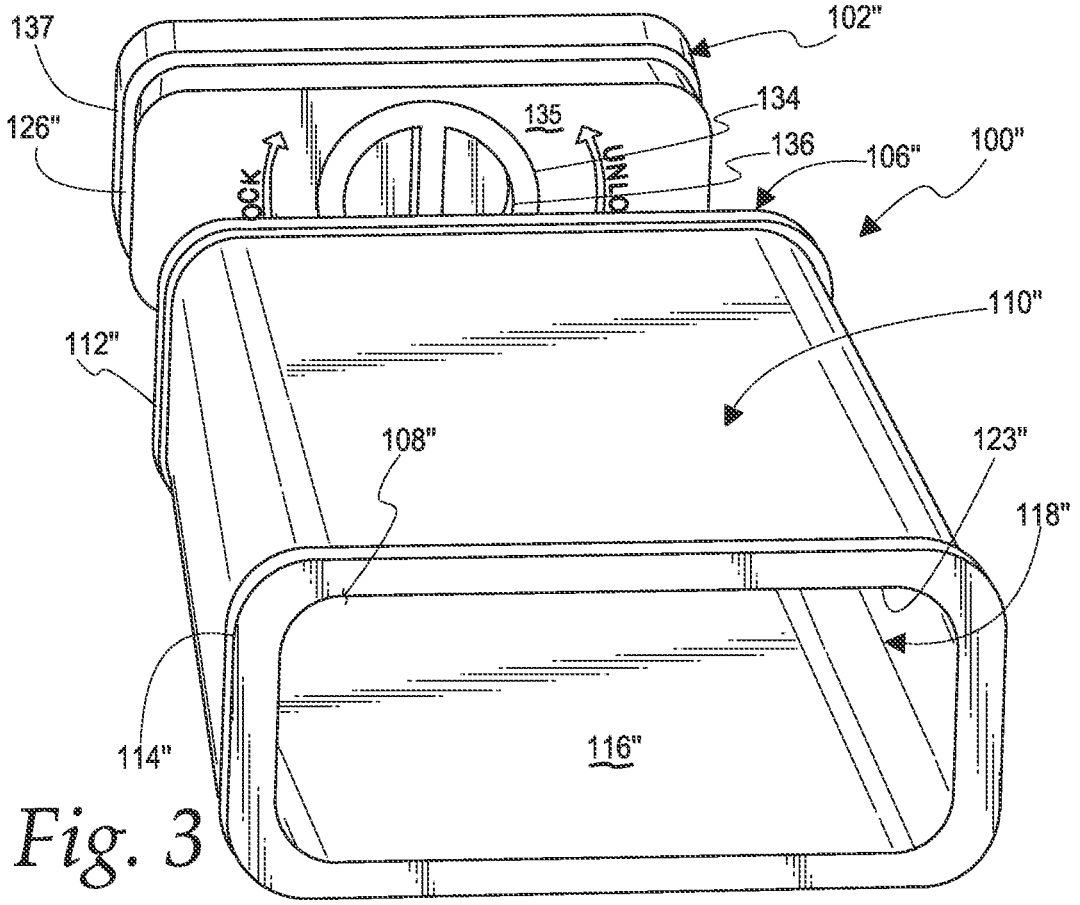
FIG. 3 is an exploded, second-end perspective view of a container according to still another embodiment.
Figure 5:
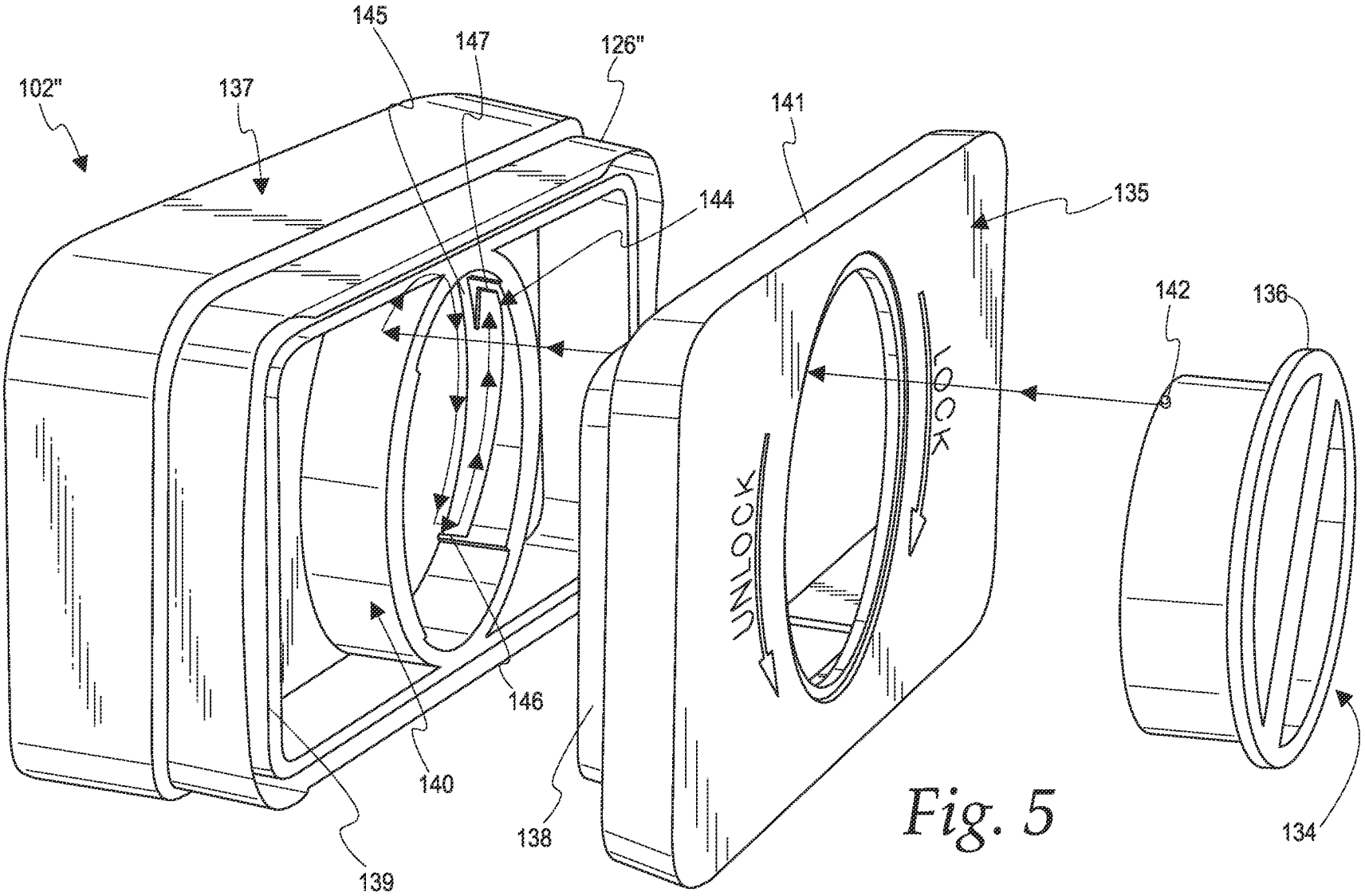
FIG. 5 is an exploded second-end perspective view of a locking movable panel of the container of FIG. 3.

Another embodiment of a container according to the disclosure is illustrated in FIGS. 3-5 as a container 100", in which structures analogous to those of the containers 100, 100' are denoted by like numerals followed by a double prime symbol (“). For ease of illustration, the container 100" is shown without a cover. According to embodiments, the container 100" may be used with any cover suitable to cover and seal its first opening 106", including but not limited to covers similar to the cover 104 or the cover 104' described above. A locking movable panel 102" is adapted and configured to insert longitudinally into the first opening 106" of the container 100", as illustrated in the exploded view of FIG. 3 and assembled view of FIG. 4. When thus inserted, the movable panel 102" is retained by the sidewall 110" for movement in opposed longitudinal directions analogously to the movable panels 102, 102'. A stop 123" analogous to the stop 123 of the container 100 limits movement of the movable panel 102" in the second longitudinal direction.

The movable panel 102" comprises a sealing and locking mechanism 134 (“locking mechanism 134”), as illustrated in FIG. 5. The locking mechanism 134 comprises a locking member 135, the locking member 135 being movably sandwiched between a manual actuator 136 and a baseplate 137 and constrained by respective mating features 138, 139 of the locking member 135 and the baseplate 137 to move longitudinally toward and away from the baseplate 137. The baseplate 137, in turn, engages the inner surface 116" of the sidewall 110" so as to be constrained to move in first and second opposed longitudinal directions within the sidewall 110". The locking member 135 is illustrated in FIG. 5 as including a peripheral skirt 141 that tapers outwardly in a longitudinal direction away from the baseplate 137. An annular sidewall contacting member 126" is retained by the baseplate 137 so as to surround the skirt 141. When the locking member 135 is moved longitudinally toward the baseplate 137, the annular sidewall contacting member 126" is pushed outwardly in all directions by the taper of the skirt 141 into sealing and frictional locking engagement with the inner surface 116" of the sidewall 110".

The manual actuator 136, in turn, is adapted and configured to produce such longitudinal movement of the locking member 135 toward the baseplate 137, in order to seal and frictionally lock the periphery of the movable panel 102" with respect to the sidewall inner surface 116". As best understood with reference to the exploded view of the movable panel 102" seen in FIG. 5, when the panel 102" is assembled, an upper portion of the manual actuator 136 extends longitudinally through an opening in the locking member 135 and into an actuator housing 140 of the baseplate 137, where the manual actuator 136 is rotatably retained. The manual actuator 136 comprises one or more pins 142, each pin 142 being adapted and configured to be retained in a respective annular cam slot 144 formed in the inner periphery of the actuator housing 140. In embodiments, an assembly clearance gap 145 above the cam slot 144 permits the panel 102" to be assembled manually by moving the manual actuator along the path indicated by the arrows, so that the pin 142 is inserted longitudinally, circumferentially traverses the assembly clearance gap 145 clockwise into the region of the cam slot 144, is retracted into engagement with the slot, and then rotated counterclockwise from a locked stop position 146 to an unlocked stop position 147, readying the panel 102" to be inserted into the sidewall 110", adjusted to a desired longitudinal position, and locked. The panel 102" can likewise be disassembled manually by reversing the assembly path of the pin 142 through the assembly clearance gap 145, to facilitate cleaning of its components.

When the movable panel 102" is fully assembled and retained in the sidewall 110" as shown in FIG. 3, reaching through the second opening 108" and rotating the manual actuator 136 in a clockwise locking direction, labeled “Lock” in the drawings, moves each pin 142 to the locked stop position 146 in the cam slot 144, whereby the pin 142 engages the cam slot 144 so as to brace the baseplate 137 and/or pull the baseplate 137 longitudinally toward the locking member 135, while a flange 148 of the manual actuator 136 engages the locking member 135 so as to brace the locking member 135 and/or push the locking member 135 longitudinally toward the baseplate 137. This produces longitudinal movement of the locking member longitudinally towards the baseplate 137, which in turn pushes the annular sidewall contacting member 126" outwardly against the sidewall inner surface 116" to seal and lock the movable panel 102". Preferably, the movable panel 102" and sidewall 110" are adapted and configured so that such sealing and locking at least substantially prevents any airflow within the interior void 118" from bypassing the panel 102" in the first longitudinal direction toward the first opening 106". Conversely, rotating the manual actuator 136 in a counterclockwise unlocking direction ("Unlock") moves the pin to the unlocked stop position 147, thereby permitting the locking member 135 and baseplate 137 to separate and remove the outward pushing force from the sidewall engaging member 126", to unlock the movable panel 102".

In other embodiments (not shown), a movable panel locking manual actuator, instead of being rotated into and out of a locked position, locks the movable panel when pushed upwardly (in the first longitudinal direction) to force a sidewall contacting member outwardly by operation of a suitable mechanical linkage. In such embodiments, to unlock the movable panel, the manual actuator may be manually pulled back downwardly, or it may be released and permitted to retract downwardly under a biasing force, such as by pressing upwardly again to trigger a suitable release mechanism (i.e., pressing the manual actuator may toggle the movable panel between sealed/locked and unsealed/unlocked states).

A movable panel having a manual locking actuator as in embodiments such as described above is believed to provide multiple benefits. For example, the ability to selectively lock the panel to the sidewall permits the panel to be configured to be more freely movable within a sidewall when unlocked than a panel that lacks a locking mechanism and is instead passively held in place by a sidewall at all times, by a passive holding force, such as friction that must be overcome by a manual force. In addition, the ability to selectively seal the panel to the sidewall may obviate the need for a separate valve to relieve pressure in the storage volume—instead, when the panel is unlocked so as to permit movement, the sidewall contacting member may also be permitted to retract inwardly from the sidewall inner surface so as to provide a pressure relieving venting clearance. Such retraction of the sidewall contacting member to open a relief vent may either be passive—e.g., by contraction of its typically elastomeric material from an internally stressed state to a relaxed state—or in response to a differential air pressure in the storage volume (which may be positive and/or negative relative to external pressure).

These and other advantages of the invention will be further understood and appreciated by those skilled in the art by reference to the following written specification, claims and appended drawings. Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

The foregoing description of the disclosure has been presented for purposes of illustration and description and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification but be defined by the claims set forth below. In addition, although narrow claims may be presented below, it should be recognized that the scope of this invention is much broader than presented by the claim (s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A container comprising a container body, the container body having a first opening, a second opening, and a sidewall, the sidewall having a first end and a second end, the first end peripherally surrounding the first opening, the second end peripherally surrounding the second opening, the sidewall extending from the second end to the first end in a first longitudinal direction and from the first end to the second end in a second longitudinal direction, the sidewall comprising an inner surface;

an interior void, the interior void peripherally surrounded by the sidewall inner surface and extending from the first opening to the second opening;

a movable panel, the movable panel being adapted and configured to be retained within the interior void by the sidewall so as to divide the interior void into a first volume and a second volume, the first volume extending longitudinally from the movable panel to the first opening and the second volume extending longitudinally from the movable panel to the second opening, the movable panel being adapted and configured to be movable from the first end of the sidewall to the second end of the sidewall in the second longitudinal direction so as to increase the first volume from the second end of the sidewall to the first end of the sidewall in the first longitudinal direction so as to reduce the first volume while continuing to be so retained by the sidewall, the movable panel having a locking mechanism that comprises a manual actuator and a-sidewall engaging member, the locking mechanism being adapted and configured so that, when the manual actuator is actuated, the sidewall engaging member presses against the sidewall inner surface and frictionally engages the sidewall inner surface so as to resist manual removal of the movable panel from the container body in the first longitudinal direction, wherein;

(1) the movable panel incorporates a baseplate;

(2) the locking mechanism incorporates a locking member movably connected to the baseplate;

(3) the sidewall engaging member is adapted to be disposed in a clearance that extends outwardly from the locking member to the sidewall; and (4) the manual actuator is adapted to be operative, when actuated, to move the locking member so as to reduce said clearance and to compress the sidewall engaging member between the locking member and the sidewall; and a cover, the cover being adapted and configured to be retained by the container body so as to cover the first opening so that the sidewall, the movable panel so retained by the sidewall, and the cover so retained by the container body enclose a storage volume, the cover so retained by the container body being manually movable to expose the first opening to allow manual dispensing of contents of the storage volume through the first opening, the storage volume comprising at least a portion of the first volume and the storage volume is configured to be reduced when the first volume is reduced by the movable panel being moved in said first longitudinal direction.

2. The container of claim 1 wherein the cover so retained by the container body is adapted and configured to be manually removable from the container body.

3. The container of claim 1 further comprising the movable panel being adapted and configured to sealingly engage the sidewall inner surface while so retained by the sidewall, and the cover being adapted and configured to sealingly engage the container body while so retained by the container body, so as to prevent airflow into the storage volume.

4. The container of claim 3 further comprising a valve, the valve being comprised in at least one of the movable panel, the sidewall, and the cover, the valve being adapted and configured to permit airflow out of the storage volume when the storage volume is reduced by the movable panel being moved in said first longitudinal direction.

5. The container of claim 4 wherein the valve is a one-way valve.

6. The container of claim 4 wherein the valve is comprised in the cover, the cover further comprising a valve actuator, the valve actuator being manually actuatable to open and close the valve, the valve being adapted and configured to permit said airflow out of the storage volume only when the valve is open.

7. The container of claim 1 wherein the movable panel comprises a locking mechanism, the locking mechanism comprising a manual actuator and a locking member, the locking mechanism being adapted and configured so that, when the manual actuator is actuated, the locking member presses a against the sidewall inner surface and frictionally engages the sidewall inner surface so as to resist manual removal of the movable panel from the container body in the first longitudinal direction.

8. The container of claim 7 wherein the movable panel is adapted and configured to sealingly engage the sidewall inner surface while so retained by the sidewall and, when the locking mechanism manual actuator is not actuated, the movable panel so retained by the container body is adapted and configured to permit airflow to vent out of the storage volume by passing between the sidewall engaging member and the sidewall inner surface when the movable panel is moved in the first longitudinal direction so as to reduce the storage volume, and when the locking mechanism manual actuator is actuated, the sidewall engaging member is adapted and configured to sealingly engage the sidewall inner surface to prevent air from passing between the sidewall engaging member and the sidewall inner surface in such a manner as to seal the storage volume.

9. The container of claim 1 wherein the first opening is adapted and configured to permit the movable panel so retained by the sidewall to be manually pushed in the second longitudinal direction by a user's hand reaching through the first opening.

10. The container of claim 1 further comprising a stop connected to the sidewall, the stop being disposed adjacent the second opening so as to abut the movable panel when the movable panel is moved in the second longitudinal direction to a stop position proximate to the second opening and so as to prevent the movable panel from being manually moved in the second longitudinal direction beyond the stop position, the movable panel in the stop position continuing to be retained by the sidewall so as to maintain the enclosure of the storage volume when the cover is so retained by the container body.

11. The container of claim 10 further comprising the container body being adapted and configured to permit the movable panel to be inserted into the interior void in the second longitudinal direction through the first opening to be so retained by the sidewall and to permit the movable panel so retained by the sidewall to be removed from the interior void in the first longitudinal direction through the first opening.

12. The container of claim 1 wherein the second opening is adapted and configured to permit the movable panel so retained by the sidewall to be manually pushed in the first longitudinal direction by a user's hand reaching through the second opening.

13. The container of claim 1 wherein the sidewall engaging member is a deformable member that is adapted and configured to sealingly engage the sidewall inner surface while the movable panel is so retained by the sidewall and, when the locking mechanism manual actuator is not actuated, the movable panel so retained by the-sidewall being adapted and configured to permit the sidewall engaging member to be deflected inwardly away from the sidewall to create a venting clearance to permit airflow to vent into and out of the storage volume by passing between the sidewall engaging member and the sidewall inner surface when the movable panel is moved in the first and second longitudinal directions so as to reduce and expand the storage volume, and the locking mechanism manual actuator being operative, when actuated, to press the sidewall engaging member outwardly against the sidewall-to prevent such inward deflection of the sidewall engaging member and such venting of the storage volume.

14. The container of claim 13 wherein the locking member comprises an outer surface that tapers outwardly towards the sidewall in a tapered region that extends in a longitudinal taper direction beyond the sidewall engaging member when the manual actuator is not actuated, the manual actuator being operative, when actuated, to move the locking member longitudinally relative to the baseplate in a longitudinal locking direction opposite the taper direction so that the tapered region aligns with at least a portion of the sidewall engaging member and compresses the sidewall engaging member against the sidewall.

15. The container of claim 14 wherein the manual actuator is movably connected to the locking member to rotate freely relative to the locking member and such that movement of the manual actuator in the locking direction is operative to drive movement of the locking member in the longitudinal locking direction, the manual actuator being movably connected to the baseplate so that rotation of the manual actuator relative to the baseplate in a rotational locking direction in a plane perpendicular to the longitudinal locking direction is operative to drive said movement of the manual actuator relative to the baseplate in the longitudinal locking direction.

16. The container of claim 15 wherein the longitudinal locking direction is toward the baseplate from the locking member and the manual actuator.

* * * * *